US005215022A

United States Patent [19]

Mullis

[11] Patent Number: 5,215,022

[45] Date of Patent: Jun. 1, 1993

[54] LOOPER CONVERSION METHOD

[76] Inventor: Lester S. Mullis, P.O. Box 495, West Jefferson, N.C. 28694

[21] Appl. No.: 832,440

[22] Filed: Feb. 7, 1992

[51] Int. Cl.[5] ..... D05B 1/20; D05B 57/00

[52] U.S. Cl. ..... 112/269.1; 112/168; 112/199

[58] Field of Search ..... 112/168, 199, 269.1, 112/162, 159, 160, 200

[56] References Cited

U.S. PATENT DOCUMENTS

| | | | |
|---|---|---|---|
| 2,778,329 | 1/1957 | Howell et al. | 112/199 |
| 2,851,974 | 9/1958 | Hayes | 112/200 X |
| 2,982,240 | 5/1961 | McCutchen | 112/80.52 |
| 3,753,410 | 8/1973 | Kostenowczyk | 112/168 X |
| 4,237,804 | 12/1980 | Hirayama | 112/168 |
| 4,942,834 | 7/1990 | Kitai | 112/199 X |
| 4,970,976 | 11/1990 | Kitai et al. | 112/168 X |

*Primary Examiner*—Clifford D. Crowder
*Assistant Examiner*—Paul C. Lewis

[57] ABSTRACT

An attachment for a looper is provided whereby one looper of a three (3) or more thread serger can be converted into a spreader for use during stitch formation. The attachment comprises a resilient band which can be quickly positioned over the throat of a looper and a longitudinal member which is pivotally attached to the band for convenient placement through the looper eyelet and which can be likewise easily manually removed without the use of tools.

3 Claims, 2 Drawing Sheets

LOOPER CONVERSION METHOD

BACKGROUND OF THE INVENTION

1. Field of the Invention

The present invention pertains to sewing machines and particularly to sergers which are used to trim and form edge overlock stitches on fabric using needles and loopers.

2. Description of the Prior Art and Objectives of the Invention

In recent years more and more housewives have become sophisticated in their sewing and garment making and are more frequently utilizing "sergers" or overlock stitching machines for trimming and completing the edges of fabric on articles such as napkins, collars and the like. Also, they are using sergers to form flat stitches such as for hemming garments. Various conventional sergers utilize from two (2) to five (5) threads depending on the particular stitch and machine design. Commercially available sergers utilizing four (4) and five (5) threads oftentimes include a conversion device attached to one (1) of the loopers whereby the looper can be modified with a screwdriver or other hand tool and used as a spreader, thereby reducing the thread number by one (1). Other types of serging machines such as the Union Special 39500 machine utilizes two (2) threads to form an overlock edge stitch but does not use a looper attachment for conversion to three (3) threads to form other types of serge stitches.

With the disadvantages of prior art converting devices for sergers, it is one objective of the present invention to provide an inexpensive, efficient quick-release attachment for a serger looper which will convert a looper to a spreader, thereby reducing the threads utilized by one (1) during stitch formation.

It is another objective of the present to provide an attachment for a looper which can be quickly, manually affixed to the looper without the use of any tools.

It is still another objective of the present invention to provide an attachment which will transform the looper into a spreader and which subsequently can be easily retransformed back into a looper.

It is also an objective of the present invention to provide a looper attachment which includes a resilient member and a pivotally attached longitudinal member which is easily positionable through the thread eyelet of the looper.

Various other advantages and objectives of the invention will become apparent to those skilled in the art as a more detailed description is presented below.

SUMMARY OF THE INVENTION

The aforesaid and other objectives are realized by providing a looper attachment which includes a resilient band to which a longitudinal member such as a wire is pivotally attached thereto. The band is forceably opened around the throat of a looper such as the lower looper of a three (3) thread serger, thereby converting the serger to a two (2) thread processor. The converted looper will then engage the needle thread for manipulative entwinement with the remaining looper thread to form an overlock edge stitch. The resilient band includes a tab for finger control and for quick manual removal of the device from the throat of the looper to reconvert the looper for handling thread in its conventional manner.

DESCRIPTION OF THE PREFERRED EMBODIMENT

Figure 2:
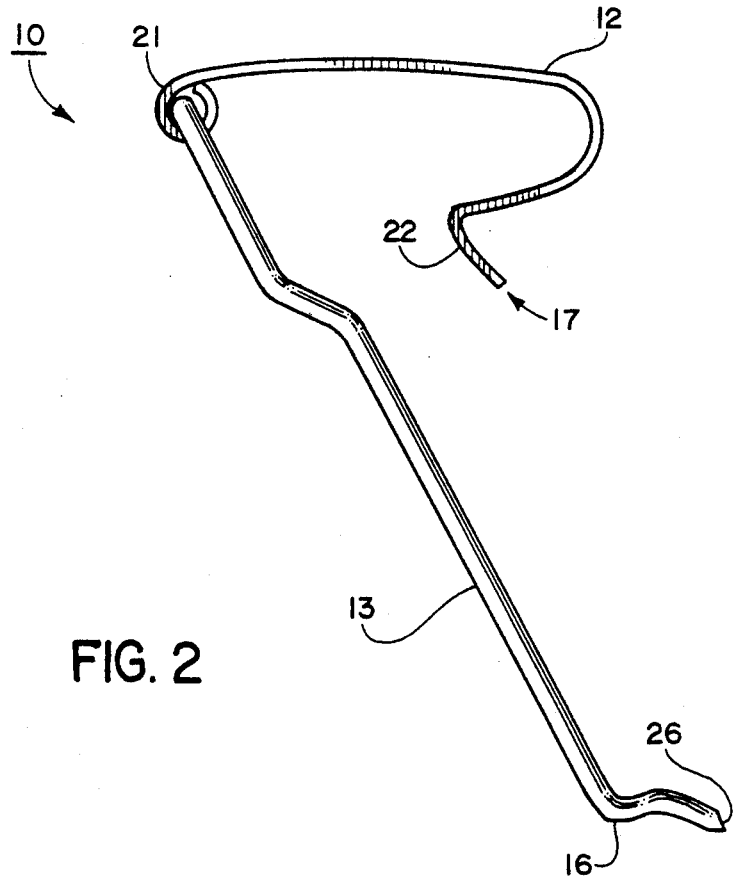
FIG. 2 illustrates the looper attachment of FIG. 1 in a top plan vie thereof.
Figure 1:
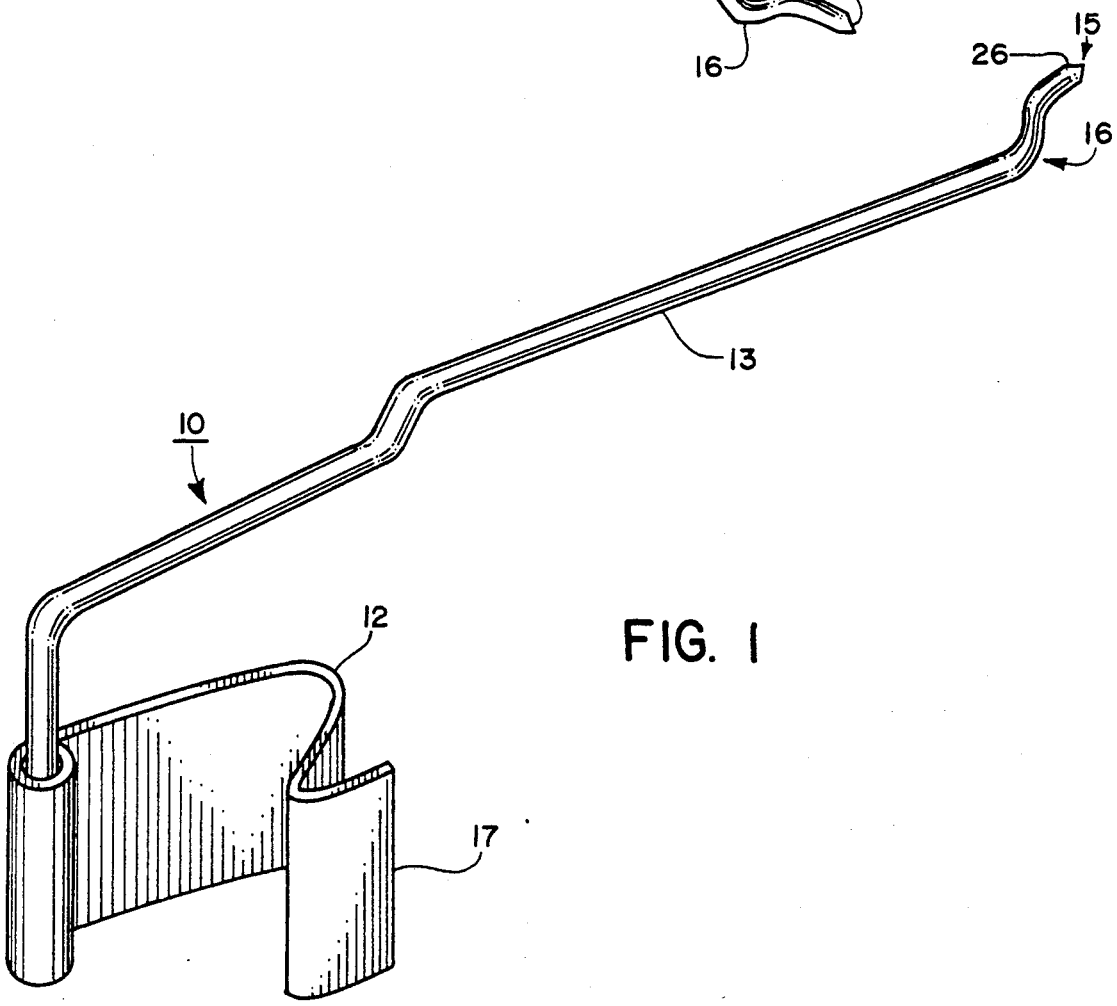
FIG. 1 demonstrates a perspective view of the looper attachment invention disengaged from a looper.
Figure 3:
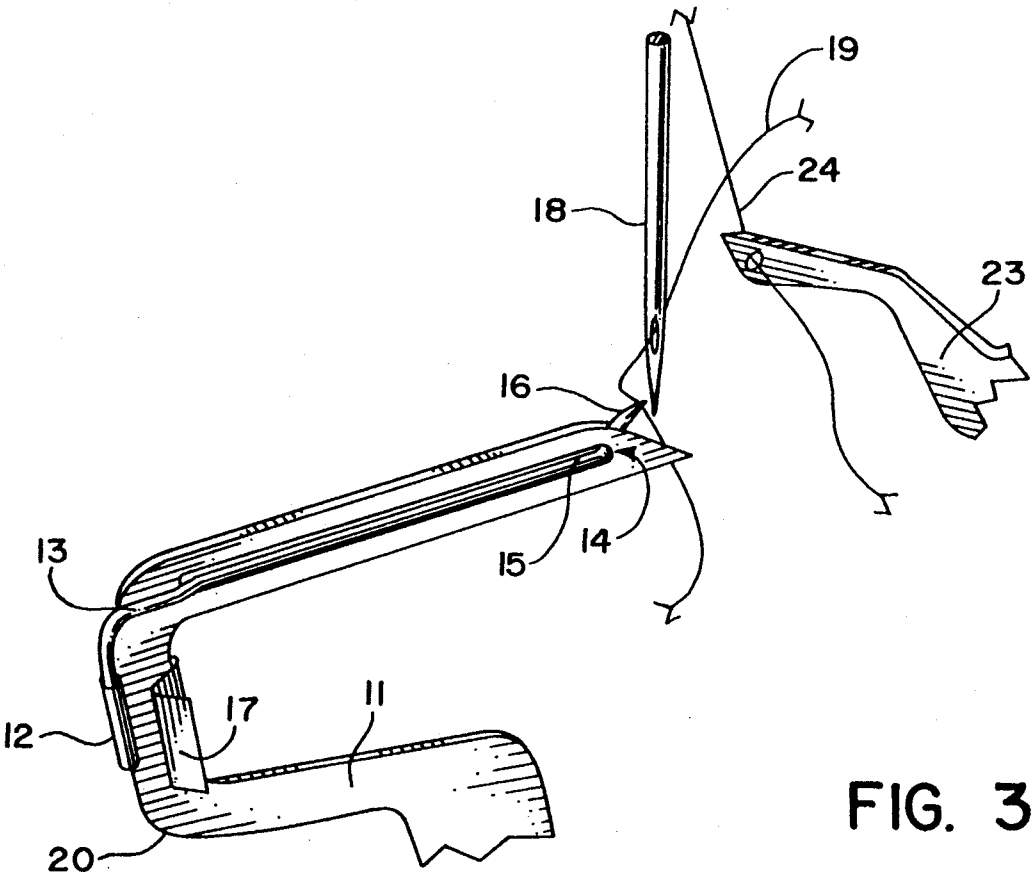
FIG. 3 shows a schematic view of the looper attachment in place for use on a conventional three (3) thread, two (2) looper serger.

The preferred form of the invention is illustrated in FIGS. 1–3 whereby the attachment band or body is formed from a resilient metal such as spring steel and the longitudinal member is formed from a rigid metal wire. The band as shown in FIG. 3 is positioned around the throat of the looper with the longitudinal member extending along the portion of the looper in the thread receiving channel with the member finger penetrating the looper thread opening at the distal end of the thread receiving channel. The longitudinal member is pivotally affixed to the resilient attachment body which has a tab positioned at the other side thereof to enable the user to quickly remove the attachment by finger pressure from the looper throat.

DETAILED DESCRIPTION OF THE DRAWINGS AND OPERATION OF THE INVENTION

For a better understanding of the invention, turning now to the drawings, FIG. 1 demonstrates looper attachment 10 remove from left or lower looper 11 as seen in FIG. 3. Looper attachment 10 includes a resilient body or band 12 which may be formed from spring steel, plastic or other suitable spring-like materials. Pivotally affixed at bearing end 21 of body 12 is longitudinal member 13 consisting of a rigid metal wire of dimensions suitable for penetration through thread eyelet or aperture 14 of looper 11. At the distal end 15 of longitudinal member 13, finger 16 extends. Finger 16 projects from longitudinal member 13 angularly at approximately 90° as shown in FIG. 2 and includes a short arcuate tip 26 affixed thereto. A tab 17 is positioned at the other end 22 of attachment body 12 to assist the user in manually releasing body 12 from looper 11. As further shown in FIG. 2, longitudinal member 13 pivots at bearing end 21 for ease in affixing and removing attachment 10 from looper throat 20.

As shown in FIG. 3, needle 18 which may be part of a three (3) thread single needle, double looper serger (not shown), carries thread 19 which is picked up and manipulated on the bottom surface of the stitched material (not shown) by finger 16. Longitudinal member 13 pivotally affixed to resilient body 12 and as shown in FIG. 3, is in place around throat 20 of looper 11. To reconvert from a spreader to a looper function, band 12 is quickly removed from throat 20 by pressing tab 17, and as band 12 is resilient, will expand or open to thereby release from throat 20. Finger 16 is then easily slid from aperture 14 and thread can then be reinserted into eyelet 14. To convert looper 11 to a spreader, the thread (not shown) for looper 11 is removed from eyelet 14, finger 16 inserted therethrough, and body 12 is then manually urged around throat 20. As further shown in FIG. 3, upper looper 23 carries thread 24 and requires no modification in the conversion from a three (3) to two (2) thread stitch when using attachment 10.

The illustrations and examples provided herein are for explanatory purposes and are not intended to limit the scope of the appended claims.

I claim:

1. A method of converting a lower looper having a throat and a threaded eyelet of a sewing device into a spreader comprising the steps of:

(a) modifying a lower looper by removing the thread from the looper eyelet, (b) urging a resilient body having a longitudinal member with a finger around the looper throat, and (c) affixing the finger through the looper eyelet for thread manipulation.

2. A method of converting a lower looper of a sewing device to a spreader, said looper having a throat and a thread receiving channel with an eyelet at the distal end of the thread receiving channel comprising the steps of:

(a) modifying a lower looper by urging a resilient body having a pivotally attached longitudinal member with a finger around the throat of the looper, and (b) inserting the finger into one side and out the other of the looper eyelet.

3. The method of claim 2 and including the step of positioning the longitudinal member along the thread receiving channel.

* * * * *